US005299992A

United States Patent [19]

Wilkinson

[11] Patent Number: 5,299,992

[45] Date of Patent: Apr. 5, 1994

[54] COMBINATION STATIONARY BICYCLE AND STEP/STAIR CLIMBER EXERCISE DEVICE

[76] Inventor: William T. Wilkinson, P.O. Box 378, Chesapeak City, Md. 21915

[21] Appl. No.: 822,895

[22] Filed: Jan. 21, 1992

[51] Int. Cl.[5] ..... A63B 22/00; A63B 22/06

[52] U.S. Cl. ..... 482/52; 482/57; 482/120; 482/62

[58] Field of Search ..... 482/57, 51, 62, 61, 482/60; D21/194, 195, 192, 191

[56] References Cited

U.S. PATENT DOCUMENTS

| | | | |
|---|---|---|---|
| D. 225,070 | 11/1972 | Proctor | 482/57 |
| D. 242,732 | 12/1976 | Brentham | D21/195 |
| D. 321,024 | 10/1991 | Brentham | D21/195 |
| 4,602,780 | 7/1986 | Gall | 482/73 |
| 4,830,362 | 5/1989 | Bull . | |
| 4,838,543 | 6/1989 | Armstrong et al. . | |
| 4,880,225 | 11/1989 | Lucas et al. . | |
| 4,917,376 | 4/1990 | Lo . | |
| 4,961,569 | 10/1990 | Roberge . | |

OTHER PUBLICATIONS

Weider Flex CTS Cross Training System Mar. 1990 Owners Manual.

Insert from "Best Catalogue", Mar. 1992.

*Primary Examiner*—Richard J. Apley

*Assistant Examiner*—Jerome Donnelly

*Attorney, Agent, or Firm*—Connolly and Hutz

[57] ABSTRACT

A combination stationary bicycle and step/stair climber exercise device containing a support surface, at least one exercise biking mechanism mounted to the support surface, at least one stepping mechanism mounted to the support surface, at least one pair of pedals connected to the biking mechanism, at least one pair of steps connected to the stepping mechanism, at least one seat connected to the top of the support surface over the biking mechanism, and at least one pair of handle bars mounted to the support surface for use with at least one of the biking mechanisms and the stepping mechanisms.

21 Claims, 3 Drawing Sheets 10
12
14
16
18
20
22
32
34
36
38
39A
39B
40
42
43
54A
54B
55
56
58
60
68

COMBINATION STATIONARY BICYCLE AND STEP/STAIR CLIMBER EXERCISE DEVICE

BACKGROUND OF THE INVENTION

Stationary exercise bicycles are one of the leading pieces of workout equipment. Recently, stair/step climbers have become highly popular. Both devices are expensive and heavy. Concurrently, there has been an increasing trend for people to exercise on more than one type of machine, whether in gyms or at home. Consequently, a number of exercise devices can be very costly, and take up a lot of space.

There is then a need to reduce the cost and space requirements associated with having a number of pieces of fitness equipment. One way this can be accomplished is by combining two or more types of exercise devices into one machine. This has a number of advantages: less expensive, space saving, more exercise variety for dollar expenditure, convenience factor for circuit training, and permits joint workouts by more than one person.

SUMMARY OF THE INVENTION

An object of this invention is to combine an exercise bicycle and step climber into one convenient exercise device.

Another object of this invention, is to have the device include a mechanism to exercise the upper body (arms), and thus be a total body exerciser.

A further object of this invention is to provide an exercising device that can be used by two people at the same time facing each other.

A still further object of this invention is to provide an exercising device that can be used by two people at the same time facing away from each other.

Yet another object of this invention is to provide a portable, light weight exercising device.

An additional object of this invention is to provide an inexpensive exercise device capable of providing a complete workout of the entire body.

Neither exercise bicycles nor climbers normally provide for an upper body workout, but rather are limited just to the leg workout. Thus, the stepper/bicycle is an ideal piece of cross/circuit training equipment, featuring a lower, upper or total body workout, while giving the user the choice of more than one type of low impact exercise, all from one machine.

A DETAILED DESCRIPTION OF THE INVENTION

Figures 1, 2, 3:
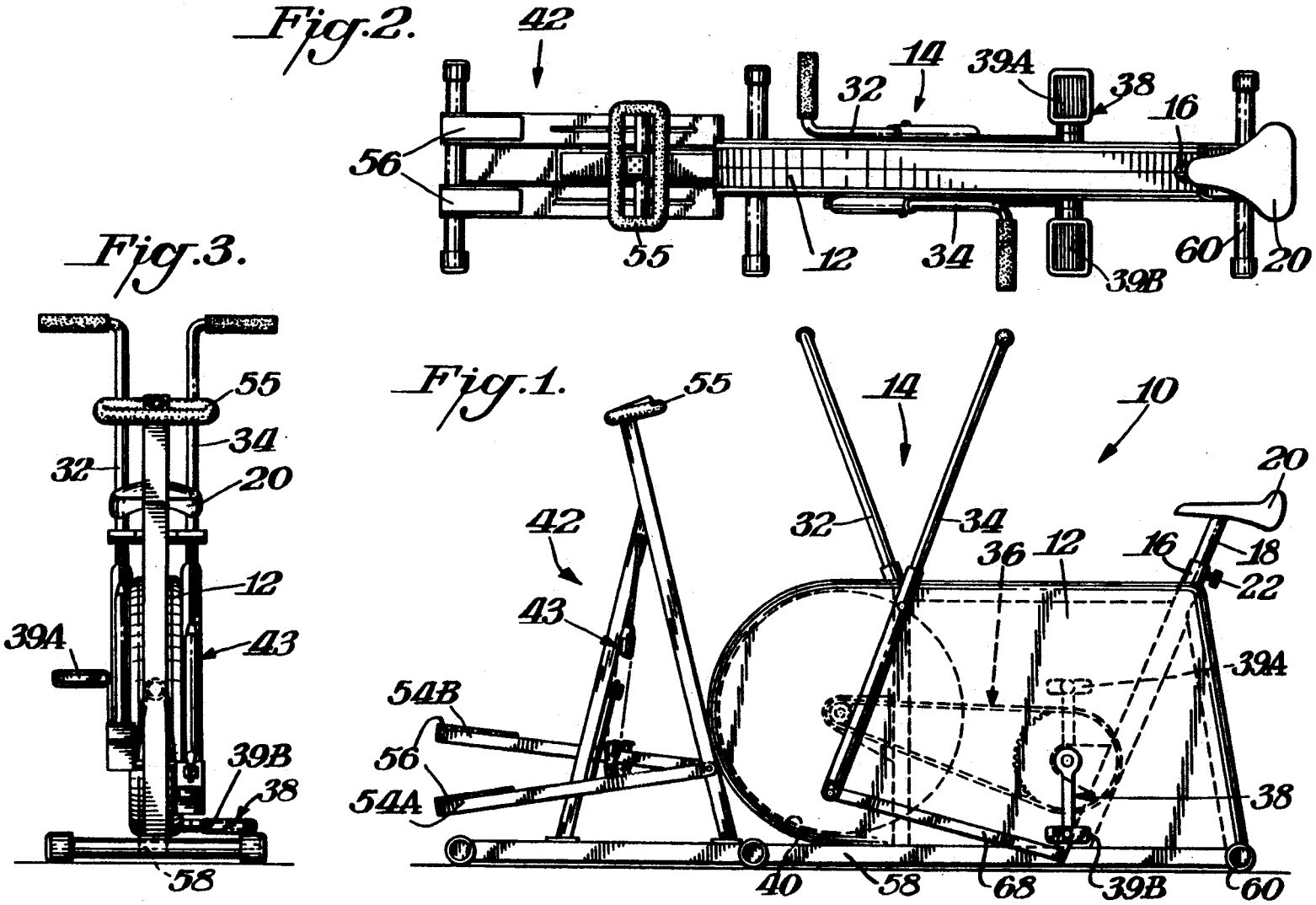
FIG. 1 is a side view of an exercise device in accordance with this invention.
FIG. 2 is a top-plan view of the exercise device shown in FIG. 1.
FIG. 3 is a front elevational view of the exercise device shown in FIGS. 1 and 2.

FIGS. 1 through 3 illustrate an exercise device 10 in accordance with this invention. Device 10 is useful for various types of exercise programs. Advantageously, the device 10 can be used by numerous individuals of different sizes and ages in accordance with different exercise needs. This is possible in part from the dimensional adjustability of the different components forming device 10. Device 10 can be used by one or more persons at the same time.

In the general device 10 includes a support surface 58 which forms a main component of this device. Support surface 58 has a stationary bicycle assembly 14 and a stepper assembly 42 mounted on it. In practice of this invention, support surface 58 has a minimum of one leg 60 mounted underneath the support surface 58. The legs 60 add stability to the device 10. The legs can be made of any suitable material such as but not limited to plastic or metal. There can be a series of legs to add more stability. The legs 60 can also be mounted perpendicular to the support surface 58, thereby raising the support surface. In that case, there would be a minimum of two legs 60 required, and preferably, at least four. A bicycle assembly 14 would be mounted to the support surface 58. There can be more than one bicycle assembly 14 mounted to such surface in a side-by-side manner. A stepping assembly 42 would also be mounted to the support surface 58. If desired, more than one stepping assembly 42 may be mounted to the support surface 58 also in a side-by-side manner.

The bicycle assembly 14 would include a fly wheel 40 and a biking mechanism 36, such as, but not limited to a chain and sprocket assembly, wheel and friction brake. Connected to the biking mechanism 36 would be a pedal assembly 38. The pedal assembly 38 would consist of two pedals, 39A and 39B that would be connected to the biking mechanism 36. The pedals 39A and 39B would be 180° apart. Optionally, mounted to the pedals 39A and 39B can be a bar 68 connecting the pedals 39*a* and 39B to the handle bars 32 and 34. The handle bars 32 and 34 can also control the pedals 39A and 39B. The handle bars 32 and 34 can be made from any suitable material such as metal or plastic.

A housing 12 can also optionally be mounted to the support surface 58 as shown in phantom in FIG. 1. A collar 16 would be mounted to the housing 12. The collar 16 is made of a tubular material such as but not limited to metal or plastic. The collar 16 can have a hole for the locking knobs 22. A stem 18 in the form of a solid or hollow tubular bar, and of a smaller diameter than the collar would extend through the collar 16. The stem 18 would have a series of aligned holes. A locking knob 22 mounted to the collar 16 would have a pin that would selectively lock into one of the holes in the stem 18, thereby being able to adjust the height of the stem. On top of the stem 18 would be mounted a bicycle seat 20. The height of the bicycle seat 20 can be adjusted by sliding the stem 18 to the desired height and locking the knob 22 through the collar 16.

A stepper assembly 42 is mounted to the support surface 58. The stepper assembly 42 consists of a stepping mechanism 43 which can incorporate a cable/-chain or pulling hydraulic cylinders, or pneumatic cylinders, springs, gears, etc., handlebars 55, and steps 54A and 54B. FIGS. 1-3 show the stepping mechanism as a pneumatic cylinder. The handlebars 55 are mounted to the support surface 58. The two steps 54A and 54B are mounted to the handlebars 55. The stepping mechanism 43 is mounted to the steps 54A and 54B. The tension of the stepping mechanism 43 can be changed by moving the stepping mechanism 43 along the steps 54A and 54B and locking the mechanism into place. The two steps 54A and 54B would have step pads 56 mounted on top of them. The step pads 56 can be made of but not limited to rubber. The step pads 56 would be long enough and wide enough for a person to place each foot on one of the step pads 56.

The steps 54 can be reversed to face inwardly or outwardly (see FIG. 8) so that the stepper can be worked out in front in tandem, behind in tandem, facing opposite, or behind facing away from the bike user.

Figure 4:
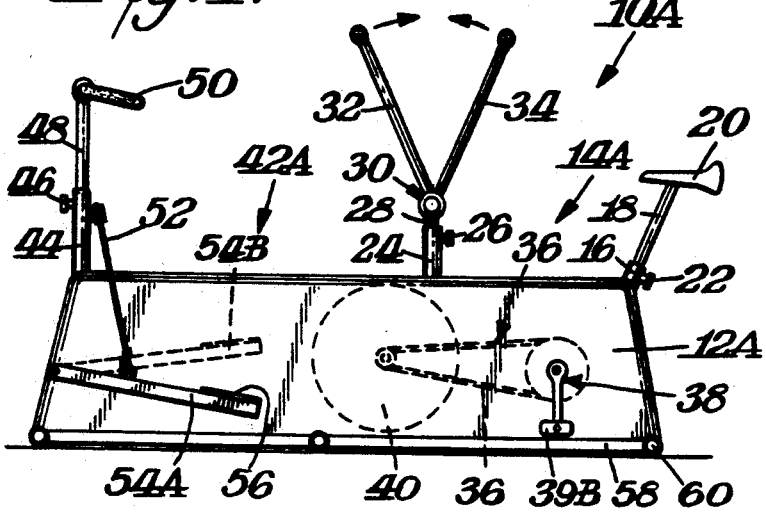
FIG. 4 is a side elevational view of a further exercise device in accordance with this invention.
Figure 5:
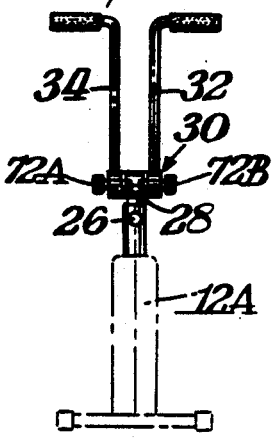
FIG. 5 is front view of the exercise device shown in FIG. 4.

A preferred practice of this invention can be seen in FIGS. 4 and 5. The preferred invention is very similar to the previously described embodiment with the main difference being in the housing 12A mounted to the support surface 58. The embodiment of FIGS. 4–5 is capable of being simultaneously used by two different people. In general, device 10A has a housing 12A mounted to the support surface 58. Biking mechanism 36 is mounted inside the housing. The pedal assembly 38 is mounted outside the housing 12A connected to the biking mechanism 36 inside the housing 12A. Pedal 39A is mounted on the outside of the housing 12A and pedal 39B is displaced 180° mounted outside on the other side of the housing 12A. The collar 16 is attached to the housing 12A. The bicycle seat 20 is adjustable by raising and lowering the bicycle stem 18 through the collar 16. Once the desired height has been achieved, locking knob 22 is turned until the pin goes through a hole in the stem 18. Once the locking knob 22 is turned to a fixed position, the seat will no longer move. Mounted to the top of the housing 12A is a removable collar 24. The collar 24 is made of either metal or plastic and is a hollow tubular cylinder. An adjustable stem 28 with a series of aligned holes fits inside the collar 24. The adjustable stem may be solid or hollow and can be made of plastic, metal or any other suitable material. A locking mechanism 26 with a pin goes through one of the holes in the adjustable stem 28 until it is at the desired position. The locking mechanism then locks the stem in place.

FIG. 5 shows a front view of the exercise device invention from FIG. 4. FIG. 5 shows the handle bars 32 and 34 clutching mechanism 30. The clutching mechanism 30 consists of two knobs 72A and 72B. These knobs can be tightened causing more pressure on the side of the wheel to adjust the tension.

The stepper assembly 42A consists of a stepping mechanism 52 which can incorporate a cable/chain or pulling hydraulic cylinders, or pneumatic cylinders, springs, gears, etc., handlebars 50, and steps 54A and 54B. FIG. 4 shows the stepping mechanism as a cable/chain. The two steps 54A and 54B are mounted to the outside of the housing 12A. Mounted to the top of the housing 12A is a removable collar 44. The collar 44 is made of either metal or plastic and is a hollow tubular cylinder. An adjustable stem 48 with a series of aligned holes fits inside the collar 44. The adjustable stem may be solid or hollow and can be made of plastic, metal or any other suitable material. A locking mechanism 46 with a pin goes through one of the holes in the adjustable stem 48 until it is at the desired position. The locking mechanism 46 then locks the stem in place. Fastened to the top of the stem 48 are handlebars 50. The stepping mechanism 43 is mounted to the steps 54A and 54B and the collar 44. The tension of the stepping mechanism 43 can be changed by moving the stepping mechanism 43 along the steps 54A and 54B and locking the mechanism into place. The two steps 54A and 54B would have step pads 56 mounted on top of them.

Figure 7:
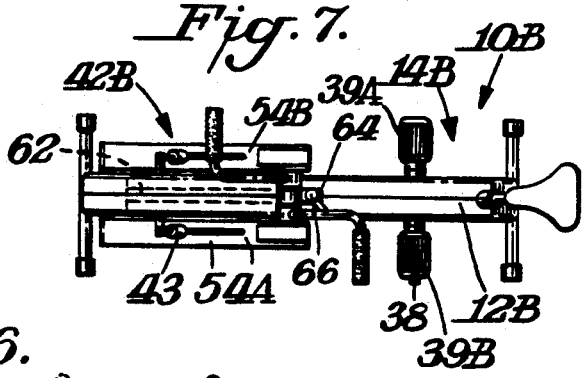
FIG. 7 is a top view of the exercise device shown in FIG. 6.
Figure 6:
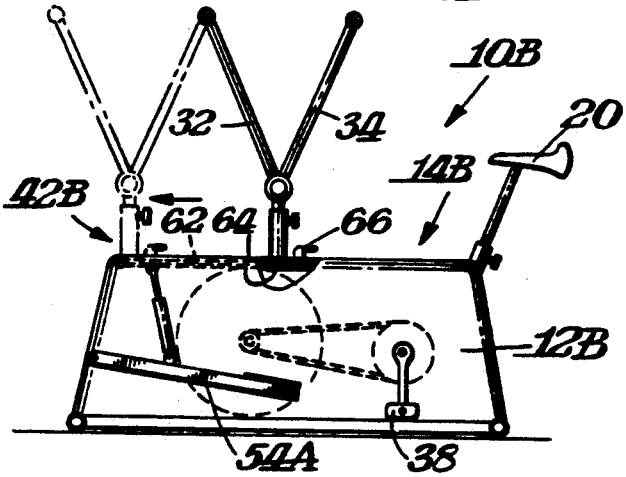
FIG. 6 is a side view of another exercise device in accordance with this invention.

The device 10B of FIGS. 6–7 is intended to be used by only one person. This device can be incorporated into any of the other embodiments previously mentioned. The location of the handle bars determines which portion of the device 10B is to be used. On top of the housing 12B is a track 62. A plate 64 is mounted on the housing 12B and slides in the track 62. The removable collar 24 is mounted on the plate 64. A locking mechanism 66 is connected to the plate 64. The locking mechanism 66 locks the plate into a stationary position. As shown in FIG. 6, the handle bars can be placed either above the stepper mechanism (as shown in phantom) or above the bicycle mechanism (as shown in solid). The handle bars are removable and adjustable and even reversible. The plate 64 can be slide down to the other end of the housing and the handle bars 32 and 34 can be mounted into place at that position. There can be two plates 64 that fit in the track and can be in two different locations on the housing. Each plate can have a collar 24 mounted to it containing handle bars 32 and 34. The handle bar mechanism can either be fixed or movable in an up and down or a back and forth direction for the bicycle or for the stepper. The seat post is either fixed or can be mounted on a plate and also slide in a track so that the seat can be movable in an up and down or back and forth direction.

The stepper assembly would consist of a pair of steps 54A and 54B and the stepping mechanism 43. The stepping mechanism 43 is connected to the outside of the housing 12B and the steps 54A and 54B.

Figure 8:
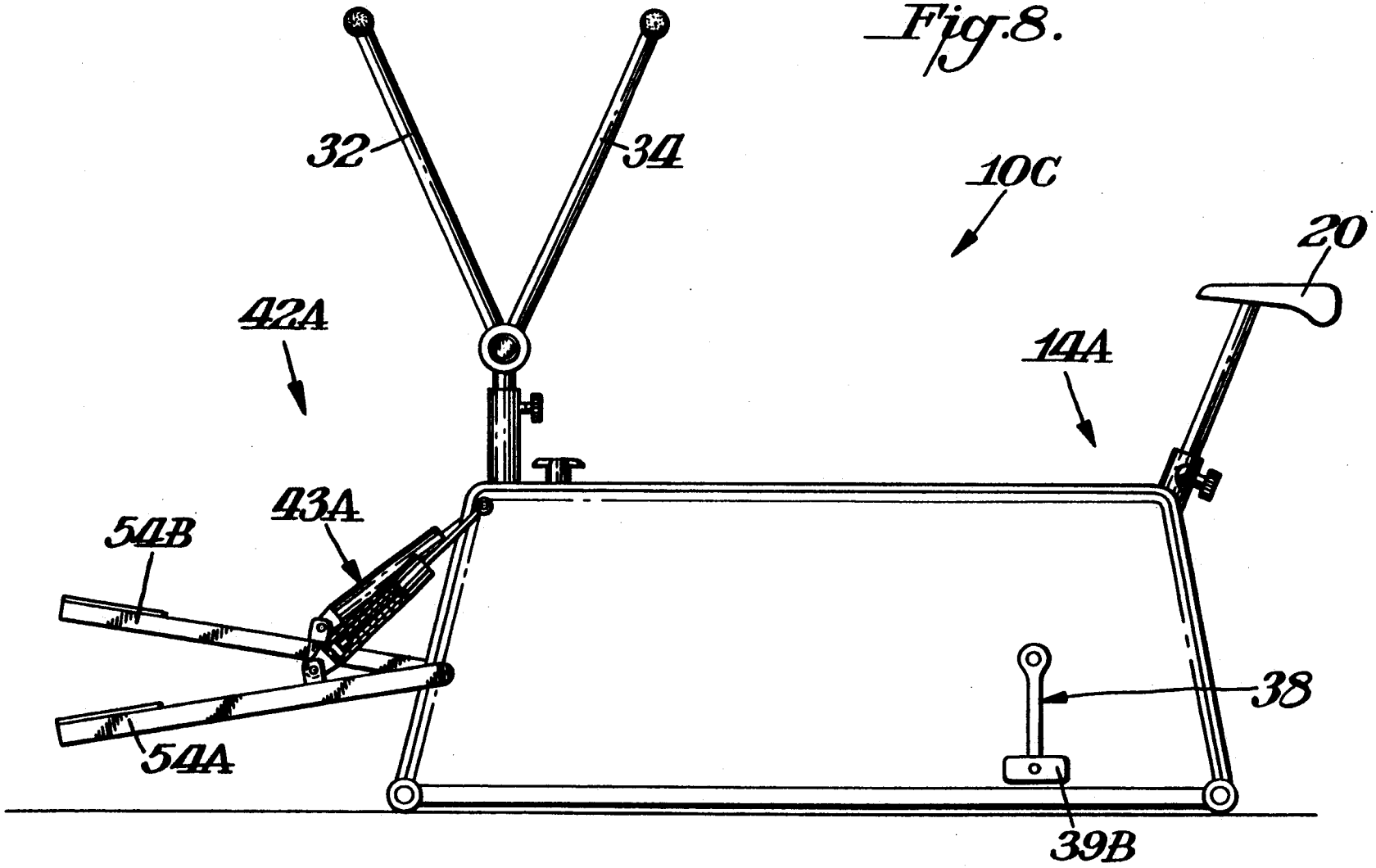
FIG. 8 is a side view of a further exercise device in accordance with this invention.

FIG. 8 shows another embodiment of the invention. The steps 54A and 54B can be reversed to extend outwardly of housing 12C. A trampoline mechanism 43A would also be capable to convert the device 10C into a stepper with a bounce. A spring would be engaged in the trampoline mechanism 43A. The user could bounce on both steps 54A and 54B simultaneously or alternately and get a trampoline effect. This embodiment could be used in addition to the stepper described.

A user can adjust the seat to the desired height. Then the user can sit on the seat. The user can either use the bike pedals and/or use the handle bars depending on the type of workout desired. If two users are going to use the device, one user can use the steps either facing towards or away from the biker. Both users can have a set of handle bars. The handle bars 32 and 34 as shown in FIGS. 4–8 can be used to by the user to develop the user's upper body. The tension of the handle bars 32 and 34 can be adjusted by tightening or loosening the knobs 72A and 72B. The user can just use the handle bars 32 and 34 without using the bicycle or stepper, if so desired. The handle bars 32 and 34 as shown in FIGS. 4–8 can be folded down for storage.

What is claimed:

1. A combination stationary bicycle and step/stair climber exercise device comprising:

a) a support surface having a front portion and a back portion, b) at least one exercise biking mechanism mounted to said support surface at either said front portion or said back portion c) at least one stepping mechanism mounted to said support surface at the other of said front portion or said back portion and thereby at the opposite portion of said support surface where the biking mechanism is mounted, d) at least one pair of pedals connected to said biking mechanism, e) at least one pair of steps, said steps each having first and second ends, said first ends of said one pair of steps being pivotally connected to said stepping mechanism and said second ends of said steps having a stepping surface, said stepping mechanism and said one pair of steps being configured so as to be:

(1) extended inwardly toward the support surface whereby a user exercising on said steps can face away from the biking mechanism when said steps are in said inward orientation;

(2) in a second direction wherein the stepping surface of the pair of steps are extended in a direction outwardly away from said support surface whereby the user exercising on said steps can face towards the biking mechanism when said steps are in said outward orientation; or (3) wherein said one pair of steps are extended inwardly toward the support surface whereby a user exercising on said steps can face away from the biking mechanism when said steps are in said inward orientation and are capable of being extended in a direction outwardly away from said support surface whereby the user exercising on said steps can face towards the biking mechanism when said steps are in said outward orientation, f) a resistance means configured so as to support said steps when extended inwardly toward said support surface and when extended outwardly away from said support surface, g) at least one seat connected to the top of said support surface over said biking mechanism, h) at least one pair of handle bars mounted to said support surface for use with at least one of said biking mechanism and said stepping mechanism, and i) a position means for said handle bars whereby said handle bars can be positioned above the stepping mechanism and above the biking mechanism.

2. An exercise device as claimed in claim 1, wherein there are two pair of handle bars.

3. An exercise device as claimed in claim 1, further comprising a housing mounted to said support surface.

4. An exercise device as claimed in claim 1, wherein said handle bars are removable and reversible.

5. An exercise device as claimed in claim 1, wherein said seat is movable in an up/down direction.

6. A method of exercising comprising using the device as claimed in claim 1, wherein at least one user sits on the seat above the biking mechanism and begins to pedal or the user places the users feet on the steps and begins to exercise.

7. The method as claimed in claim 6 wherein there is one user exercising with the biking mechanism and another user exercising with the stepping mechanism.

8. An exercise device as claimed in claim 1, wherein said stepping mechanism and one pair of steps being configured so as to allow said steps to be oriented in opposite directions as desired, wherein said one pair of steps being extended inwardly toward the support surface and in a second direction wherein the stepping surface of the pair of steps are extended in a direction outwardly, away from said support surface.

9. An exercise device as claimed in claim 1, wherein the stepping surface of said one pair of steps are extended inwardly toward the support surface.

10. An exercise device as claimed in claim 1, wherein the stepping surface of said one pair of steps are extended outwardly away from the support surface.

11. A combination stationary bicycle and step/stair climber exercise device comprising:

a) a support surface, b) a housing having a front half and a rear half mounted on said support surface, c) at least one exercise biking mechanism mounted to said support surface inside said housing, at either the front half or the rear half of said housing, d) at least one stepping mechanism mounted to said support surface inside said housing, at either the front half or the rear half of said housing, e) at least one pair of pedals connected to said biking mechanism mounted on the outside of the housing, f) at least one pair of steps, said steps each having first and second ends, said first ends of said one pair of steps being pivotally connected to said stepping mechanism and said second ends of said steps having a stepping surface, said stepping mechanism and said one pair of steps being configured so as to be:

(1) extended inwardly toward the support surface whereby a user exercising on said steps can face away from the biking mechanism when said steps are in said inward orientation:

(2) in a second direction wherein the stepping surface of the pair of steps are extended in a direction outwardly away from said support surface whereby the user exercising on said steps can face towards the biking mechanism when said steps are in said outward orientation; or (3) wherein said one pair of steps are extended inwardly toward the support surface whereby a user exercising on said steps can face away from the biking mechanism when said steps are in said inward orientation and are capable of being extended in a direction outwardly away from said support surface whereby the user exercising on said steps can face towards the biking mechanism when said steps are in said outward orientation.

g) a resistance means configured so as to support said steps when extended inwardly toward said support surface and when extended outwardly away from said support surface.

h) at least one seat connected to the top of said housing over said biking mechanism, i) at least one handle bars mounted to said housing for use with at least one of said biking and said stepping mechanism, and j) a position means for said handle bars above the stepping mechanism and above the biking mechanism wherein said handle bars can be positioned above the stepping mechanism and above the biking mechanism.

12. An exercise device as claimed in claim 11, wherein said handle bars are mounted above said biking mechanism.

13. An exercise device as claimed in claim 11, wherein said handle bars are mounted for the use of said stepping mechanism.

14. An exercise device as claimed in claim 11, comprising at least two sets of handle bars.

15. An exercise device as claimed in claim 11, wherein said handle bars are removable.

16. An exercise device as claimed in claim 11, wherein said handle bars are reversible.

17. An exercise device as claimed in claim 11, wherein said seat is movable in an up/down direction.

18. The exercise device as claimed in claim 11, wherein there are two handle bars, one positioned over said biking mechanism and the other positioned over said stepping mechanism.

19. An exercise device as claimed in claim 8, wherein said stepping mechanism and one pair of steps being configured so as to allow said steps to be oriented in opposite directions as desired, wherein said one pair of steps being extended inwardly toward the support surface and in a second direction wherein the stepping surface of the pair of steps are extended in a direction outwardly, away from said support surface.

20. An exercise device as claimed in claim 11, wherein the stepping surface of said one pair of steps are extended inwardly toward the support surface.

21. An exercise device as claimed in claim 12, wherein the stepping surface of said one pair of steps are extended outwardly away from the support surface.

* * * * *